US005183325A

United States Patent [19]

Hurdle

[11] Patent Number: 5,183,325

[45] Date of Patent: Feb. 2, 1993

[54] ILLUMINATION APPARATUS FOR REMOTE CONTROL DEVICE

[75] Inventor: Terry D. Hurdle, Newport Beach, Calif.

[73] Assignee: D. T. Hurdle, Newport Beach, Calif.

[21] Appl. No.: 594,834

[22] Filed: Oct. 9, 1990

[51] Int. Cl.[5] ..... F21V 33/00

[52] U.S. Cl. ..... 362/109; 362/253; 362/368; 362/802

[58] Field of Search ..... 362/109, 191, 253, 802, 362/310, 368, 370, 375, 23, 98, 99, 295, 394; 248/121, 174

[56] References Cited

U.S. PATENT DOCUMENTS

| | | | |
|---|---|---|---|
| 1,145,848 | 7/1915 | Robins | 362/99 |
| 3,092,335 | 6/1963 | Wilson | 362/191 |
| 4,204,272 | 5/1980 | Kim | 362/200 |
| 4,390,928 | 6/1983 | Runge | 362/802 |
| 4,432,042 | 2/1984 | Zeller | 362/183 |
| 4,535,392 | 8/1985 | Montgomery | 362/295 |
| 4,823,241 | 4/1989 | Trattner | 362/190 |
| 4,893,222 | 1/1990 | Mintzer | 362/253 |
| 4,905,127 | 2/1990 | Kaminski | 362/23 |
| 4,949,230 | 8/1990 | Burmeister | 362/23 |

*Primary Examiner*—Ira S. Lazarus
*Assistant Examiner*—Y. Quach

[57] ABSTRACT

An illumination device for illumination of the controlling elements of a remote control device for use in a darkened atmosphere. A bracket attaches to a remote control device and supports a lamp circuit and suitable enclosure in a position adjacent to the operating elements of the remote control. When the remote control is tilted, a gravity actuated switch completes the lamp circuit, thereby activating a lamp that illuminates the operating elements of the remote control. When the remote control is returned to a horizontal position, the circuit is broken and the lamp is deactivated.

3 Claims, 2 Drawing Sheets

ILLUMINATION APPARATUS FOR REMOTE CONTROL DEVICE

FIELD OF THE INVENTION

This invention relates to illumination devices. More specifically, this invention relates to battery-operated illumination devices that are used to illuminate portable objects.

BACKGROUND OF THE INVENTION

Remote control devices are commonly used with home appliances, such as televisions and stereo systems, and allow the user to control the operation of these appliances from some distance away. Such home appliances are often used in a darkened atmosphere. Many people find it easier, for example, to view a television picture in a darkened room. Likewise, many find that a darkened atmosphere enhances the musical atmosphere that their stereo system produces. A darkened atmosphere, however, often inhibits a person's clear view of the operating elements of a remote control device, and consequently such a device becomes difficult to use. For example, if a control button is pressed inadvertently as a result of not being able to read the remote control's indicators clearly, an undesirable change in the operation of the appliance will result. Thus, using remote control devices in a darkened atmosphere may often lead to a more frustrating than enjoyable experience.

Frequently, in a darkened atmosphere, a person must activate a light source, such as a room lamp, to more clearly see the indicators of a remote control. This procedure is inconvenient, and consequently is often bypassed.

Well documented portable illumination apparati are common. However, a portable battery-operated illumination means for use in conjunction with a remote control device is a neglected area of development. A portable book light, for example, has been designed that is supported frictionally to the cover of a book with a clamping means, the lamp element transversely movable and activated manually. This book light is not suited for use with a common remote control in that it is not designed to attach to a remote control, is too complex to operate for the simple task of momentarily illuminating the operating elements of a remote control. Clearly there still exists a need for a convenient, easily operable means of momentarily illuminating the operating elements of a remote control within a darkened atmosphere.

SUMMARY OF THE INVENTION

The present invention is an apparatus for illuminating the operating elements of a remote control device. A support bracket easily attaches to the remote control and supports an enclosure for a light source and associated circuitry. The light source, for example, a low-voltage incandescent lamp, is positioned such that it illuminates the operating elements of the remote control device but does not hinder the user's view of such elements. The lamp circuit utilizes a battery, a switch, a lamp, and electrical conductors in such a way that closing the switch completes the circuit and activates the lamp. Opening the switch breaks the circuit and deactivates the lamp. A gravity actuated switch may be used so that tilting the illumination device activates the lamp.

This invention provides a convenient means by which to illuminate the operating elements of a remote control device for use in a darkened atmosphere. Other features and advantages of the present invention will become apparent from the following more detailed description, taken in conjunction with the accompanying drawings, which illustrate, by way of example, the principles of the invention.

DESCRIPTION OF THE DRAWINGS

The accompanying drawings illustrate the invention. In such drawings.

DETAILED DESCRIPTION OF THE PREFERRED EMBODIMENT

Figure 1:
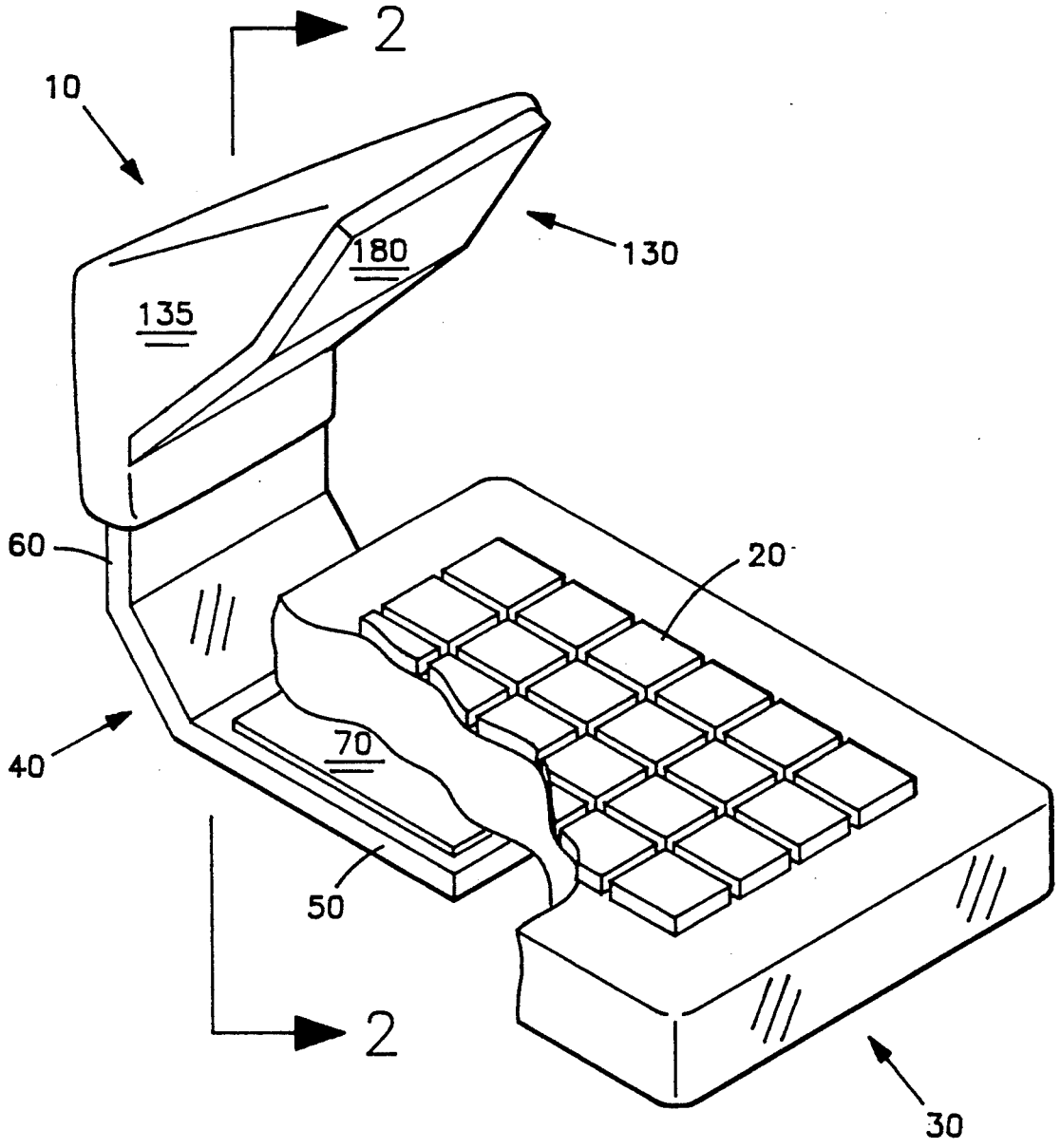
FIG. 1 is a perspective view of the invention with a cut away view of a remote control device to illustrate the attachment means of the invention.
Figure 2:
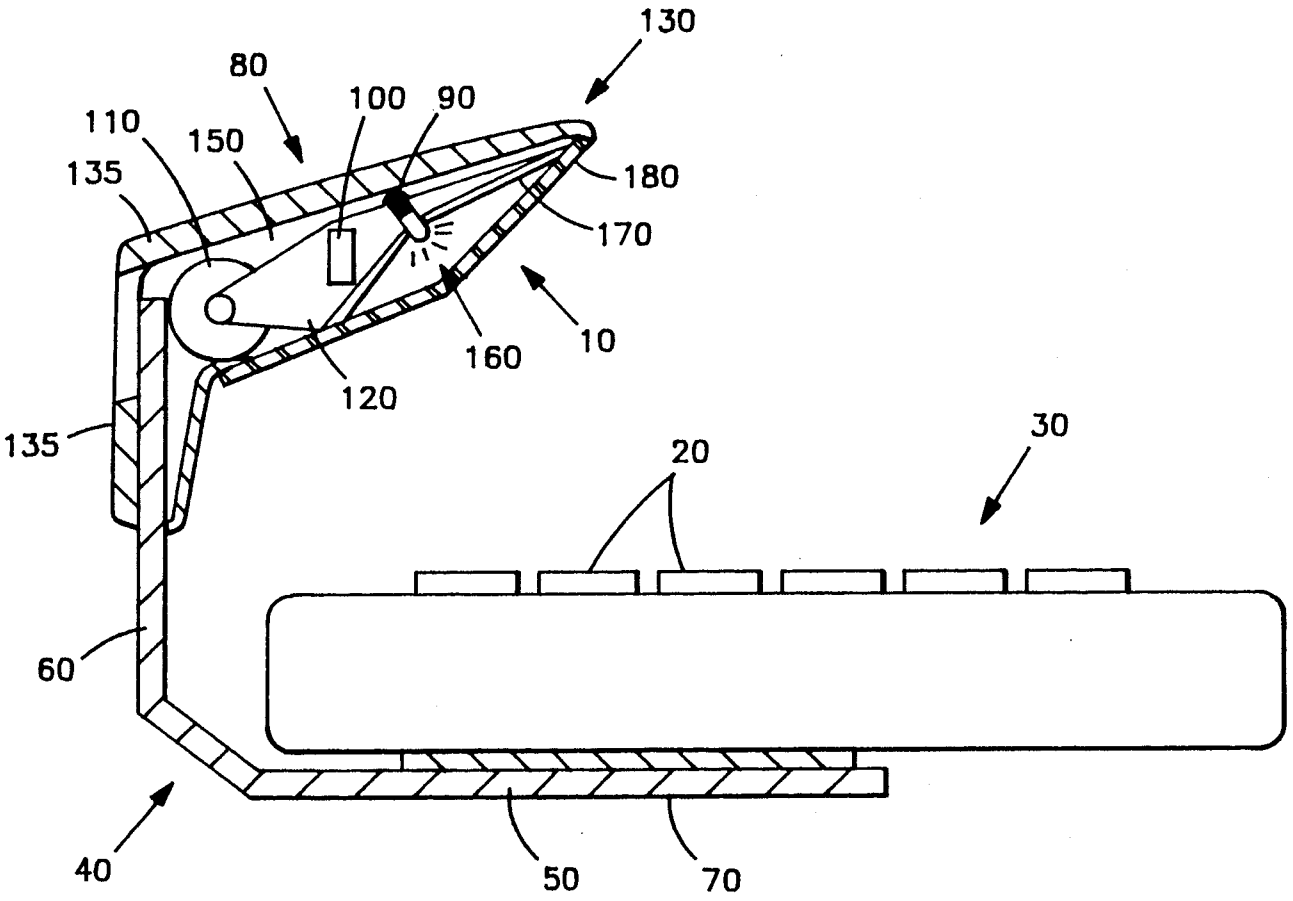
FIG. 2 is a cross sectional view of the invention taken generally along line 2—2 of FIG. 1.
Figure 3:
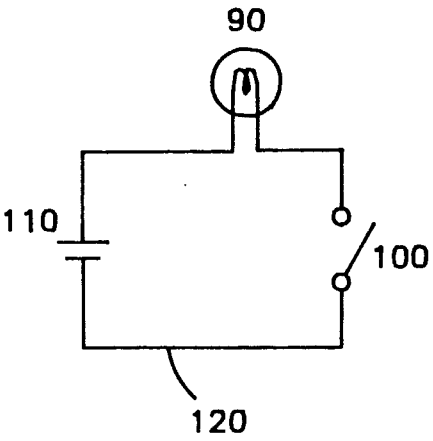
FIG. 3 is a circuit diagram of the invention.

FIGS. 1 and 2 show an illumination device 10 for illuminating operating elements 20 of a remote control device 30. A rigid first leg 50 and a rigid second leg 60, composed of a strong opaque or translucent material, are joined at an approximate right angle to form an approximately L-shaped bracket 40. An attachment means 70, such as adhesive foam tape or hook and loop fastener, secures the first leg 50 to the remote control 30 such that the second leg 60 is positioned adjacent to the operating elements 20. The second leg 60 is designed so as not to interfere with light producing elements of the remote control 30. Further, the first leg 50 and the second leg 60, differing in length therebetween, are interchangeable to better correspond to the dimensions of any remote control 30. Still further, protective pads may be included on the underside of the first leg 50 to protect furniture and the like from inadvertant and potentially damaging contact between the first leg 50 and the furniture.

Enclosure walls 135 of an enclosure 130, formed from a strong yet aesthetically pleasing plastic or metallic material, hold by friction the second leg 60 therebetween. A cavity 150 is formed within the enclosure 130 for holding a lamp circuit 80, a reflector 170, and a translucent cover 180. The lamp circuit 80 is comprised of an incandescent, halogen, or other lamp 90, a switch 100, a battery 110, and electrical conductors 120, such that when the switch 100 is closed the lamp circuit 80 is completed, thereby activating the lamp 90. When the switch 100 is opened, the lamp circuit 80 is opened thereby deactivating the lamp 90. The reflector 170 is included to reflect the light 160 produced from the lamp 90 onto the operating elements 20. A translucent cover 180 protects the lamp 90 and the reflector 170 while allowing the light 160 to pass therethrough. An opening 136 in the enclosure wall 135 is provided to allow access to the cavity 150 for changing the battery 110. The second leg 60 is designed to cover the opening 136 when the second leg 60 is fully inserted into the enclosure 130.

In the preferred embodiment, the switch 100 is gravity actuated so that tilting the switch 100 will complete the lamp circuit 80. It will be understood that a variety of common switching means could be utilized that would not significantly alter the scope or spirit of the invention. For example, a touch-activated switching means may be employed.

In operation, the remote control 30 is removed from a horizontal surface, such as a table, and is tilted such that the gravity actuated switch 100 completes the lamp circuit 80, thereby activating the lamp 90 to produce light 160 for illuminating the operating elements 20 of the remote control 30. After the desired operating element 20 is selected and activated, the remote control 30 is returned to a horizontal position, thereby deactivating the switch 100 and breaking the lamp circuit 80.

To replace the battery 110 the user pulls the second leg 60 partially out of the enclosure 130 to expose the battery 110 through the opening 136. The battery 110 is then replaced, and the second leg 60 then re-inserted into the enclosure 130 to fully cover the opening 136.

It will be understood that the preferred embodiment of the invention is not intended to limit in scope or spirit the invention. For example, one may still adequately illuminate the control elements 20 of a remote control 30 with the enclosure 130 positioned along the first leg 50, the only modification being that the lamp 90 is not contained in the enclosure 130 but is itself attached to the second leg 60. In such an embodiment, the reflector 170 could be built into the leg 60, and the cover 180 could be designed to fit around the leg 60 to protect the lamp 90. In another possible embodiment, in order to achieve a more uniform illumination of the operating elements 20 a plurality of lamps 90 could be utilized.

In one preferred embodiment the first leg 50 is attached to the flat bottom surface 75 of the remote device 30 while the second leg 60 is positioned adjacent to the window 65 for transmission of infrared energy 68. The bracket 40 is made of a material such as polycarbonate plastic, which is transparent to the signal 68 generated by the remote 30 which is most frequently an infrared energy signal. The means for mounting enclosure 130 to the bracket 40 is a slot 66 in the enclosure 130 into which the end 55 of either leg may be inserted to hold the enclosure 130 in place.

Thus, the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. An apparatus for illuminating the operating elements of a remote control device, the remote control device being of the type having operating elements, and having a window for transmission of a signal, and having a generally flat bottom surface, the apparatus comprising:

an "L" shaped bracket made of a material transparent to the signal, the bracket having a first and a second legs, the legs being of different lengths and joined at an approximate right angle;

a means of illumination contained in;

an enclosure, the enclosure having means for mounting the enclosure onto the end of either the first or the second leg;

a means of attachment for connecting either the first or the second leg to the flat bottom surface of the remote control device, the alternate leg extending upwardly parallel to the window for transmission, the enclosure being supported by the alternate leg at a position above the operating elements in order to provide illumination to the elements, whereby either leg may be used to hold the enclosure thereby providing two alternate elevations of the enclosure above the remote control.

2. An apparatus for illuminating the operating elements of a remote control device, the remote control device being of the type having operating elements, and having a window for transmission of infrared energy, and having a generally flat bottom surface, the apparatus comprising:

an "L" shaped bracket made of a material transparent to energy transmitted in the infrared spectrum, the bracket having a first and a second legs, the legs being of different lengths and joined at an approximate right angle;

a lamp circuit including electrical components; a lamp, a switch capable of making a circuit, and a battery; the components being interconnected by electrical conductors, the circuit providing illumination when the switch is made;

an enclosure for holding the circuit, the enclosure having a means for mounting the enclosure onto the end of either the first or the second leg;

a means of attachment for connecting either the first or the second leg to the flat bottom surface of the remote control device, the alternate leg extending upwardly parallel to the window for transmission, the enclosure being supported by the alternate leg at a position above the operating elements in order to provide illumination to the elements, whereby either leg may be used to hold the enclosure thereby providing two alternate elevations of the enclosure above the remote control.

3. The apparatus of claim 2 wherein the means for mounting the enclosure is a slot defined by the enclosure wall, the slot accomodating the insertion of either leg of the bracket, and wherein an opening defined by the enclosure wall allows insertion of the battery, the slot being positioned to allow the end of the leg to touch the battery to hold the battery in place and to block passage of the battery through the opening when the enclosure is mounted upon the bracket.

* * * * *